US011566295B2

(12) United States Patent
Aota et al.

(10) Patent No.: US 11,566,295 B2
(45) Date of Patent: Jan. 31, 2023

(54) LEATHER SKIVING MACHINE

(71) Applicant: NIPPY KIKAI CO., LTD., Hyogo (JP)

(72) Inventors: Takashi Aota, Shimomiyaki-cho Kasai (JP); Michiaki Kanata, Himeji (JP)

(73) Assignee: NIPPY KIKAI CO., LTD., Hyogo (JP)

( * ) Notice: Subject to any disclaimer, the term of this patent is extended or adjusted under 35 U.S.C. 154(b) by 120 days.

(21) Appl. No.: 17/255,463

(22) PCT Filed: Sep. 19, 2018

(86) PCT No.: PCT/JP2018/034588
§ 371 (c)(1),
(2) Date: Dec. 23, 2020

(87) PCT Pub. No.: WO2020/059038
PCT Pub. Date: Mar. 26, 2020

(65) Prior Publication Data

US 2021/0254187 A1 Aug. 19, 2021

(51) Int. Cl.
*C14B 1/16* (2006.01)

(52) U.S. Cl.
CPC ..... *C14B 1/16* (2013.01)

(58) Field of Classification Search
CPC ..... C14B 1/14; C14B 1/16
See application file for complete search history.

(56) References Cited

U.S. PATENT DOCUMENTS 1,095,293 A * 5/1914 Smith ..... C14B 1/14 69/11
1,450,407 A 4/1923 Bradford et al.
1,511,054 A * 10/1924 Duncan ..... C14B 1/14 83/450
2,305,618 A * 12/1942 Jester ..... C14B 5/00 69/16

(Continued)

FOREIGN PATENT DOCUMENTS

JP 11977033686 8/1975
JP 59-165442 U 11/1984

(Continued)

OTHER PUBLICATIONS

Office Action dated Dec. 24, 2019 in corresponding Japan Application No. 2019-520917, with English translation.

(Continued)

*Primary Examiner* — Shaun R Hurley
(74) *Attorney, Agent, or Firm* — Renner, Otto, Boisselle & Sklar, LLP

(57) ABSTRACT

Provided is a compact and lightweight leather skiving machine capable of skiving both hard leather and soft leather through oscillation of a flat blade. The leather skiving machine is characterized by comprising at least a table upon which a piece of leather is placed, a roller for moving the leather, a presser foot for pressing down the leather, a flat blade for skiving the leather, and a drive mechanism for moving each of the roller and the flat blade, wherein the leather is sandwiched from above and below by the roller (Continued)

and the presser foot at a pressing point on the table while being moved, and the flat blade is provided at a position 0-5 mm in the movement direction from the pressing point and skives while oscillating the leather.

17 Claims, 5 Drawing Sheets

(56) References Cited

U.S. PATENT DOCUMENTS

| | | | | |
|---|---|---|---|---|
| 2,753,709 | A * | 7/1956 | Beck | A43D 93/00 74/478 |
| 4,444,028 | A | 4/1984 | Repetto | |

FOREIGN PATENT DOCUMENTS

| | | | |
|---|---|---|---|
| JP | 05-295400 | A | 11/1993 |
| JP | 1998148256 | A | 6/1998 |
| JP | 2004-195574 | A | 7/2004 |
| JP | 2017-519123 | A | 7/2017 |
| WO | 2008/105011 | A1 | 9/2008 |

OTHER PUBLICATIONS

Written Amendment dated Jan. 6, 2020 in corresponding Japan Patent Application No. 2019-520917, with English translation of claims.

Decision to Grant dated Mar. 16, 2020 in corresponding Japan Patent Application No. 2019-520917, with English translation.

* cited by examiner

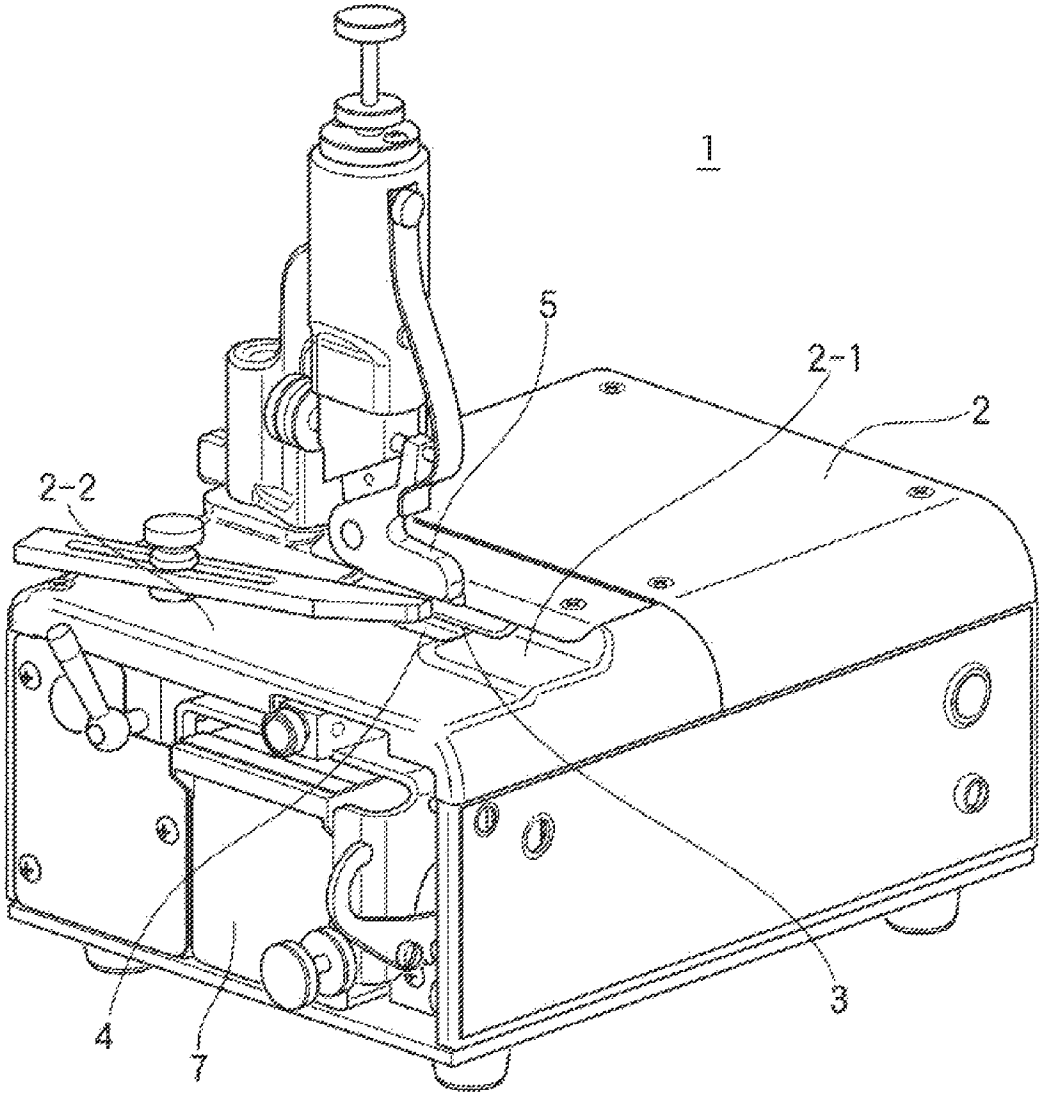
[Fig. 1]

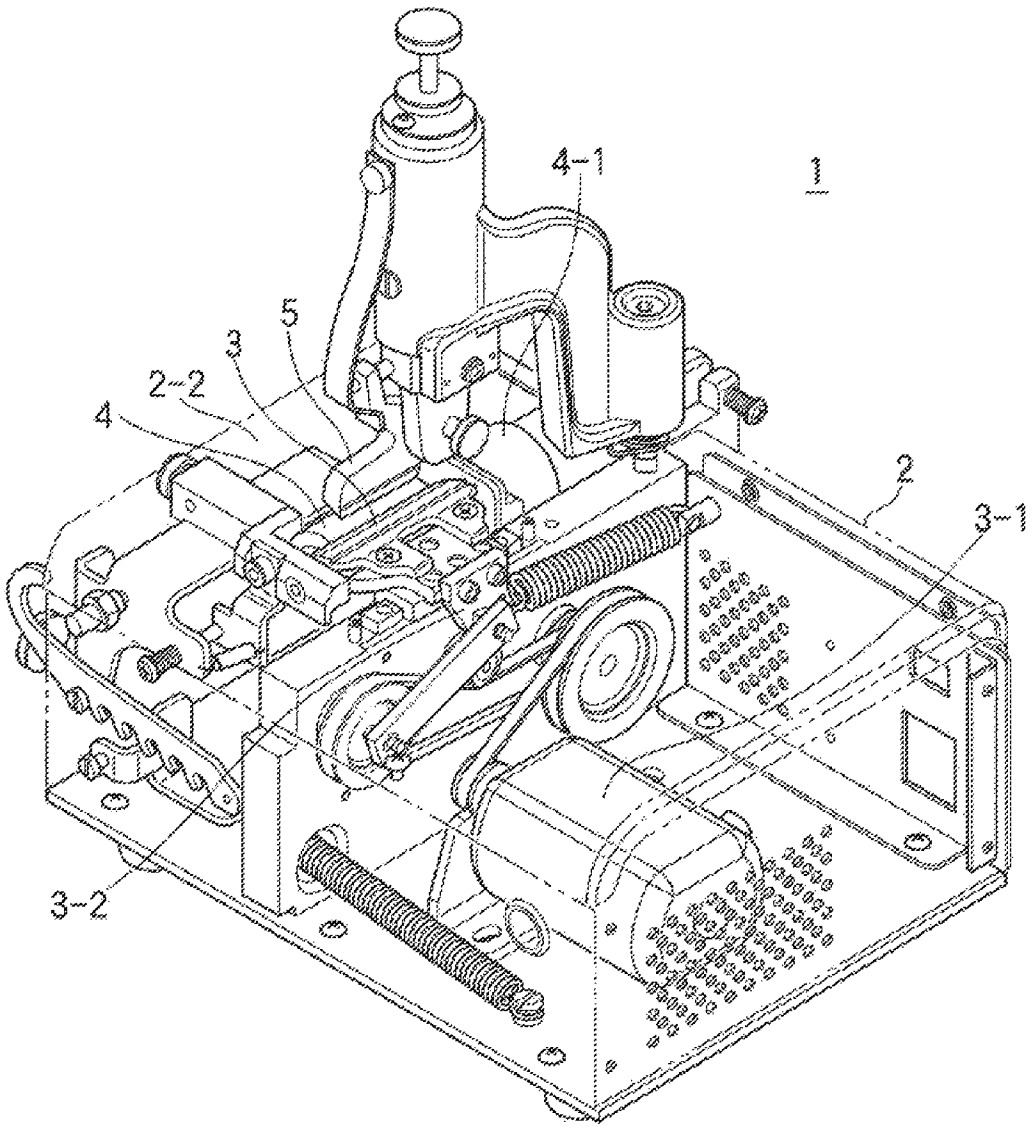
[Fig. 2]

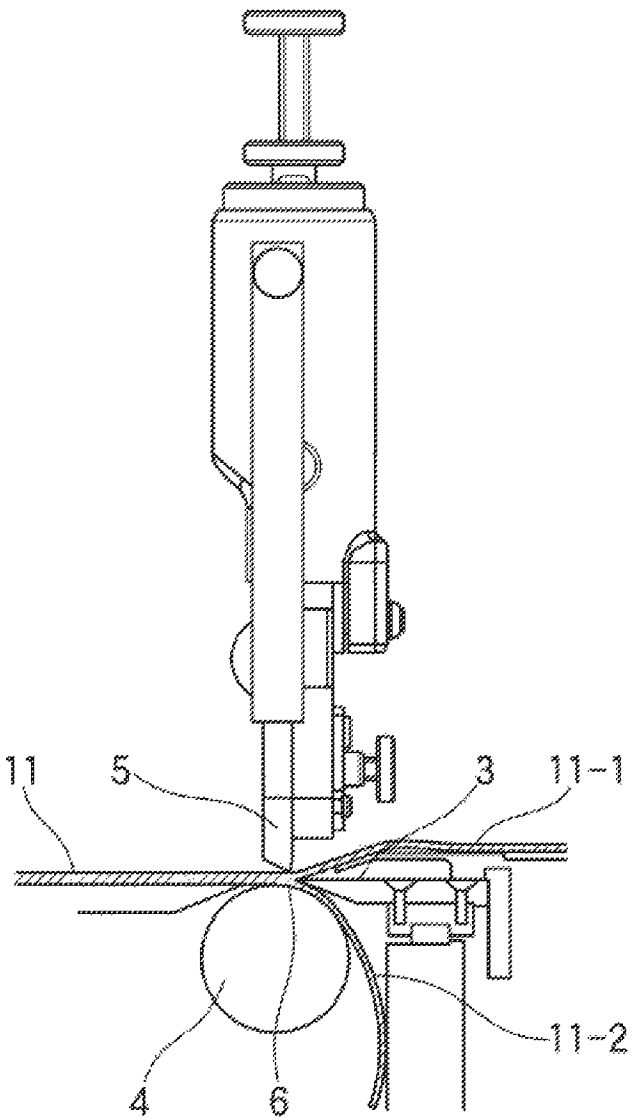
[Fig. 3]

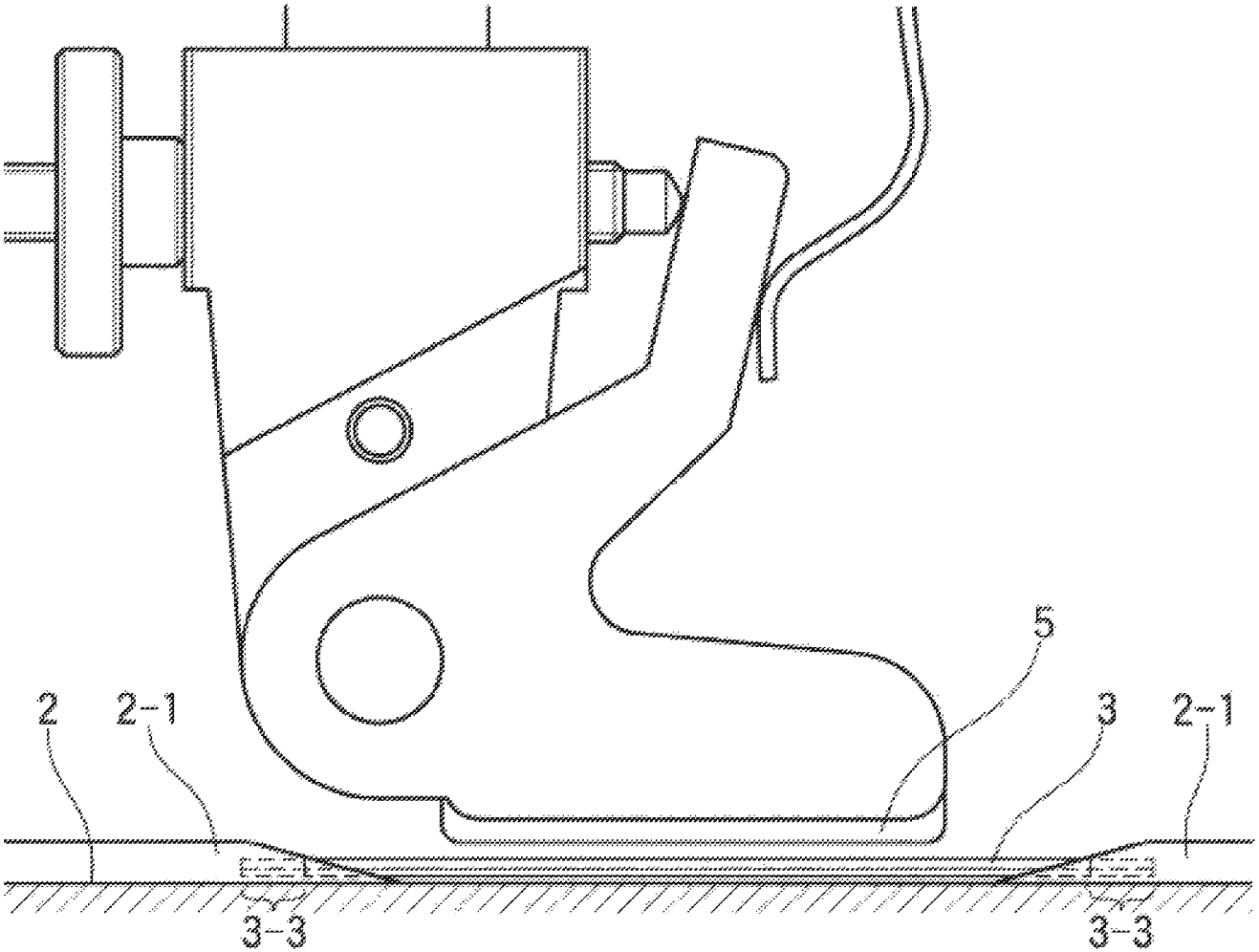
[Fig. 4]

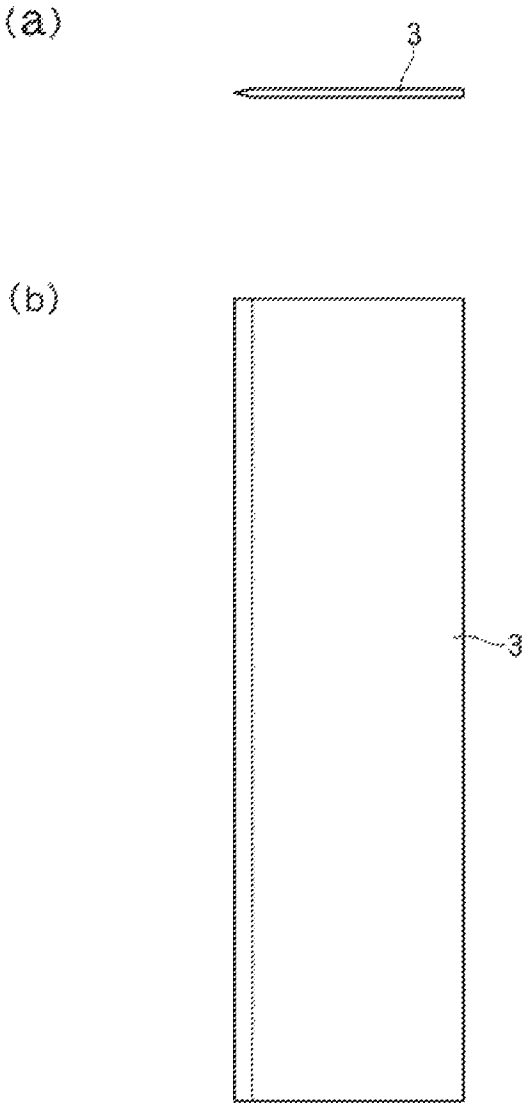
[Fig. 5]

LEATHER SKIVING MACHINE

This application is a national phase of International Application No. PCT/JP2018/034588 filed Sep. 19, 2018, in the Japan Patent Office, which is hereby incorporated herein by reference.

Japanese Patent Application No. 2019-520917 filed Apr. 17, 2019, in the Japan Patent Office also is a national phase of International Application No. PCT/JP2018/034588 and is also hereby incorporated herein by reference.

TECHNICAL FIELD

The present invention relates to a small leather skiving machine that can be used at home by people who have a hobby of leather craft.

BACKGROUND ART

Conventionally, a leather skiving machine for commercial use is main current, uses a cylindrical round blade, and skives leather. Since a conventional product is for commercial use, it was assumed that the blade would be used frequently, and a polishing mechanism using a grindstone is provided in order to round a cutting edge of the blade. A round blade is sharpened using that mechanism, a maturity of skill is needed to sharpen the cutting edge for the best of the state, and it could not be cut depending on a person who sharpened it. In addition, there is a risk of fire because sparks are scattered when sharpening the blade. In addition, the sharpening mechanism will increase weight and manufacturing cost of the leather skiving machine. It also requires a large machine work space. Also, a preparation of the machine is large-scale, the machine could not be put out quickly and put away quickly, and it was not suitable for home use.

Therefore, there is disclosed a prior art of a band-shaped leather shaving machine that skives leather mainly with a flat blade manually without using a drive mechanism (Patent Literature 1).

CITATION LIST

Patent Literature

Patent Literature 1

Japanese Unexamined Patent Application Publication Sho No. 54-126701 (Claims, pp. 2, lower right column 2-6 lines, FIG. 5)

SUMMARY OF INVENTION

Technical Problem

The prior art in the patent literature is superior in that it is lighter than the commercial leather skiving machine, but a person must operate a lever to move the flat blade with a right hand and with some force and must hold the leather with a left hand. There was a problem that the operation was complicated and not easy. Since the blade moves only in a certain direction, only hard leather can be skived, and there is a problem that soft leather cannot be skived well. Further, since the machine is used for a strip-like leather connecting skiving, there is a problem that it is not possible to skive a leather wider than the width of the blade. In addition, since a leather of an object to be skived is fixed and skived, there is a risk that the skived surface will have a step for each action of a lever if the leather is skived continuously. There is a risk that a curve will not be skived and a planar edge will not be skived continuously.

The present invention was created as a solution for the problems and aims at providing a leather skiving machine that is small and lightweight, can be easily operated by anyone, and can be used to make hard or soft leather by oscillating a flat blade.

Solution to Problem

In order to achieve the above object, a leather skiving machine according to the present invention includes at least a table upon which a piece of leather is placed, a roller for moving the leather, a presser foot for pressing down the leather, a flat blade for skiving the leather, and a drive mechanism for moving each of the roller and the flat blade. The leather is sandwiched from top and bottom by the roller and the presser foot at a pressing point on the table while being moved, and the flat blade is provided at a position 0-5 mm in the movement direction from the pressing point and oscillates while skiving the leather.

By adopting this configuration, the leather skiving machine according to the present invention includes at least a table upon which a piece of leather is placed, a roller for moving the leather, a presser foot for pressing down the leather, a flat blade for skiving the leather, and a drive mechanism for moving each of the roller and the flat blade, and the leather skiving machine sandwiches the leather from top and bottom by the roller and the presser foot, moves the leather to the flat blade with the roller, and skives the leather while oscillating the flat blade. Therefore, since the flat blade is used, even if the thickness of the leather is changed, it is possible to skive the leather with a uniform thickness. Further, since the flat blade is oscillated parallel to the blade, an action of cutting is added to the leather, and a bite of the blade is improved. Therefore, it is possible to skive a soft leather. A distance between the pressing point and the flat blade can be changed as appropriate according to a hardness of the leather. As a result, it is possible to skive the leather at the optimum sharpness position, and prevent the leather from getting stuck between the flat blade and the roller. In addition, the distance between the pressing point and the flat blade is preferably 0 to 5 mm.

Further, since the leather skiving machine according to the present invention does not polish the blade with a grindstone, it is possible not to scatter sparks, to suppress a fire, and to use safely at home.

Further, the leather skiving machine according to the present invention is that the drive mechanism is an independent drive mechanism for each of the roller and the flat blade oscillating in the leather skiving machine.

Therefore, since the leather skiving machine according to the present invention has an independent drive mechanism, it is possible to simplify the structure. Further, since a power transmission mechanism having a complicated structure is not required, it is possible to use a grease-filled ball bearing and oil-less metal member for bearings and sliding parts. Therefore, since the leather skiving machine can be made maintenance-free, it is possible to use as a household-use leather skiving machine that can be used by ordinary people who are not good at maintenance. Moreover, since a load per drive motor is small, it is possible to use a small drive motor. Therefore, the leather skiving machine can be made smaller and lighter.

The leather skiving machine according to the present invention is that the flat blade is a double-edged blade in the leather skiving machine. Further, the leather skiving machine according to the present invention is that projecting parts for covering each of both ends of the oscillating flat blade is provided at a position in front of the pressing point on the table in the leather skiving machine. Further, the leather skiving machine according to the present invention is that a portion of the presser foot pressing the leather has a width between the projecting parts in the leather skiving machine. Further, the leather skiving machine according to the present invention is that a space for placing the leather is provided on the front side of the flat blade and on the table in the leather skiving machine.

The leather skiving machine will skive at a certain range of a position of the blade. Since the flat blade of the leather skiving machine according to the present invention is the double-edged blade, when skiving the leather, the leather skiving machine can straighten a travel direction of the leather without warping, and it is easy to keep a thickness of the leather constant. Also, if the blade becomes dull, by turning 180 degrees of the blade and using it upside down, you can bring an unused part of the blade to the position of the blade you normally use, the number of replacements of the blade itself can be reduced, and it saves resources. Also, the blade can use a blade of both sides of the double-edged blade, in that case, if the blade becomes dull, by turning 180 degrees and left and right of the blade and using it, the position of the blade can be changed four times, and the number of replacements of the blade itself can be reduced.

In addition, the projecting parts that can cover each of the ends of the flat blade is provided at both ends in front of the flat blade of the table of the leather skiving machine, when the flat blade oscillating, it is possible to prevent the leather from being caught in the ends of the flat blade. Therefore, it is possible to prevent the trouble that the leather is caught in the leather skiving machine and maintain a comfortable working environment. Further, since the presser foot presses the leather between both projecting parts of the table, it is possible to press the leather reliably. Therefore, the quality of the skived leather can be maintained at a high level.

Further, the leather skiving machine according to the present invention has a space for placing the leather before skiving on the front side of the flat blade and on the table, it is possible to place the leather on the space. Therefore, the worker does not have to hold the leather and can concentrate on the work of skiving the leather, and the work of making is easier.

Advantageous Effects of Invention

According to the leather skiving machine according to the present invention, it is compact and lightweight, it is maintenance-free, it is easy to prepare and clean up, and there is no risk of fire, so it is ideal as a household leather skiving machine. In addition, since the leather is skived by oscillating the flat blade, it is possible to skive any thickness of the leather with a uniform thickness, and skive any leather regardless of the hardness of the leather. By the way, if it is a round blade, a curved presser foot is required, but if the thickness of the leather changes, it is troublesome to require a presser foot with a matching curvature (Actually, it is not possible to prepare all the presser foots that match the curvature), so this point is also improved with the flat blade.

BRIEF DESCRIPTION OF DRAWINGS

FIG. 1 is a schematic perspective view of the leather skiving machine which concerns on embodiment of this invention.

FIG. 2 is a schematic structural view of the leather skiving machine which concerns on embodiment of this invention.

FIG. 3 is a schematic cross-sectional view of a part of the pressing point by sandwiching the leather between the roller and the presser foot in the leather skiving machine which concerns on embodiment of this invention.

FIG. 4 is a typical front view which shows the positional relationship between the presser foot, the projecting parts of the table, and the flat blade in the leather skiving machine which concerns on embodiment of this invention.

FIG. 5 (*a*) is a schematic cross-sectional view of the flat blade.

FIG. 5 (*b*) is a schematic plan view of the flat blade in the leather skiving machine which concerns on embodiment of this invention.

DESCRIPTION OF EMBODIMENTS

The leather skiving machine 1 according to the present invention is made of metal or resin, and as shown in FIGS. 1 and 2, comprises at least a table 2, a oscillating flat blade 3, a presser foot 5 for pressing a leather 11 at a position of a pressing point 6, a roller 4 for sending the leather 11 to a position of the flat blade 3 while sandwiching the leather 11 with the presser foot 5 at the position of the pressing point 6, a flat blade oscillating motor 3-1 for oscillating the flat blade 3, a flat blade oscillating mechanism 3-2 and a roller motor 4-1 for rotating the roller 4.

The table 2 is a box body, and includes at least the flat blade 3, the flat blade oscillating mechanism 3-2, the flat blade oscillating motor 3-1, the roller 4, and the roller motor 4-1 inside, and a cutting edge of the flat blade 3 and an upper end of the roller 4 are exposed on an upper surface of the table 2, and further, comprises at least two projecting parts 2-1 for hiding each of both ends of the flat blade 3, and a space 2-2 for placing the leather 11.

As shown in FIG. 5, since the flat blade 3 is a flat blade, even if a thickness of the leather 11 is changed, it is possible to skive uniformly with the same thickness at the center and edges of the leather 11. Further, since the flat blade 3 oscillates horizontally (parallel to the blade and in the left-right direction) by the flat blade oscillating motor 3-1 and the flat blade oscillating mechanism 3-2, it is possible to skive by an action of cutting the leather 11 even if the leather is a soft leather. Further, a horizontal position of the flat blade 3 are fixed, and the pressing point 6 (pressing foot 5) can be moved closer to or separated from the blade according to a hardness of the leather 11. Further, since both ends of the flat blade 3 oscillates at position hidden by the projecting parts 2-1 of the table 2 respectively, it prevents troubles such as machine stoppage or breakdown when the leather 11 is caught by the ends of the flat blade 3. The flat blade oscillating mechanism 3-2, for example, as shown in FIG. 2, is a slider crank mechanism. Further, since the flat blade 3 is a blade of both sides of the double-edged blade, a place where the blade 3 is frequently used due to oscillating is a part, even if the blade 3 becomes hard to cut, if it is used by turning it upside down, front and back, left and right, it is possible to bring an infrequently used part of the blade 3 to a frequently used part. Therefore, the number of spare blades purchased can be reduced. The position of the flat blade 3 in a horizontal direction and a vertical direction are fixed. Further, the flat blade 3 is basically used by turning it over when it becomes difficult to cut, and replacing it when it becomes difficult to cut next, and the blade 3 can be removed from the leather skiving machine 1 and re-sharpened.

The roller 4 is coaxial with the roller motor 4-1 and is rotated by the roller motor 4-1 to feed the leather 11 to a position of the flat blade 3. The leather skiving machine 1 according to the present invention can hold the lather 11 from bottom by the roller 4 and from top by the presser foot 5 at the position of the pressing point 6 to stop the leather 11 moving in the vertical direction. As a result, the flat blade 3 can oscillate and skive while the flat blade 3 cutting into the leather 11. The roller 4 can be finely adjusted in the vertical direction and can be moved in the vertical direction by an action of a spring, further, since the vertical position of the flat blade 3 is fixed, the thickness of the leather 11-2 that is discarded by skiving the leather 11 can be adjusted. Further, when receiving an excessive load from the presser foot 5, the roller 4 and the roller motor 4-1 can move downward by the action of the spring and relieve the excessive load. As a result, it is possible to prevent the roller from receiving the excessive load and failing. The unnecessary leather 11-2 after being skived is put into a dust box 7 as it is and discarded after the work is completed.

The presser foot 5 presses the leather 11 from top at the position of the pressing point 6 and sandwiches the leather 11 with the roller 4 so that the leather 11 does not move in the vertical direction. The presser foot 5 can be finely adjusted in the vertical direction, and since the vertical position of the flat blade 3 is fixed, the thickness of the skived leather 11-1 can be adjusted. Further, by adjusting a position of an arm to which the presser foot 5 is attached, a horizontal position of the presser point 6 can be adjusted, further, since the position of the flat blade 3 in the horizontal direction is fixed, it is possible to adjust an optimum positional relationship between the flat blade 3 and the pressing point 6 as appropriate depending on the hardness of the leather 11. It is preferable that a width of a portion of the presser foot 5 that presses the leather 11 is a length between the two projecting portions 2-1 of the table 2, so that the leather 11 can be reliably pressed. The presser foot 5 can be replaced depending on a size and a type of the pressed leather 11.

Next, an example of the manufacturing method of the leather skiving machine 1 according to the present invention will be shown. As shown in FIG. 2, after a partition wall is attached to a lower box of the table 2 processed into a predetermined shape, the flat blade oscillating motor 3-1, the flat blade oscillating mechanism 3-2, etc. are fixed to the lower box of the table 2 with bolts etc. and the flat blade 3 is attached to the flat blade oscillating mechanism 3-2. After that, a table (an upper member of the table 2 side the roller 4) processed into a predetermined shape is attached to the lower box of the table 2, and then, a set of a presser foot arm to which the presser foot 5 is attached is attached to the table 2, and an unit equipped with a roller motor 4-1 and a roller 4 is attached, after performing a predetermined wiring, a cover (an upper member of the table 2 side the flat blade oscillating motor 3-1) is fixed to the lower box of the table 2 with bolts to complete the process. Since the structure of the leather skiving machine 1 according to the present invention is not complicated, a maintenance-free member such as a grease-filled ball bearing can be used as a member, and no problem occurs even if a purchaser who is not good at maintenance uses it.

Next, an example of how to use the leather skiving machine 1 according to the present invention will be shown. The leather skiving machine 1 is placed on a table and a plug is inserted into an outlet. A height of the presser foot 5 is adjusted so that the skived-up leather 11-1 has a predetermined thickness, and a horizontal position of the arm attached to the presser foot 5 is adjusted according to the hardness of the leather 11 as necessary. After that, the leather 11 is placed on the space 2-2 of the table 2, and then a switch is turned on to drive the motor 4-1 that rotates the roller 4 and the motor 3-1 that oscillates the flat blade 3. When an operator moves the leather 11 toward the flat blade 3 with both hands, the leather 11 is placed on the roller 4 and moved, is sandwiched between the roller 4 and the presser foot 5 at the pressing point 6, and after the leather 11 does not move in the vertical direction, the flat blade 3 oscillates and skives the leather 11. After the leather 11 is skived, a necessary leather 11-2 moves on the table 2, and an unnecessary leather 11-2 is stored in the dust box 7 by the roller 4. After the work is completed, the power is turned off, the unnecessary leather 11-2 stored in the dust box 7 is thrown away, and then the leather skiving machine 1 is put away to complete the work. Since the unit provided with the roller 4 and the roller motor 4-1 has the spring, the unit moves in the vertical direction according to the thickness of the unnecessary leather 11-2 and the unnecessary leather 11-2 can be discharged.

If the leather skiving machine 1 according to the present invention is used, it is lightweight, compact, maintenance-free, and easy to prepare and clean up the machine, so that it is most suitable for home use. Further, even if the thickness of the skived leather 11 changes, it is possible to skive with a uniform thickness on the left and right. In addition, the leather 11 can be skived regardless of the hardness of the leather 11. Moreover, since the flat blade 3 is easy to replace and there is no need to sharpen the blade, it does not take time and effort. Further, since the leather skiving machine 1 according to the present invention does not have a grindstone inside, there is no risk of fire due to the sharpening work, and the weight can be reduced.

INDUSTRIAL APPLICABILITY

The present invention can be widely used as a leather skiving machine.

REFERENCE SIGNS LIST

1: Leather skiving machine
2: Table 2-1: Projecting part 2-2: (Table) Space
3: Flat blade 3-1: Flat blade oscillating motor 3-2: Flat blade oscillating mechanism
3-3: Oscillating width at the end of the flat blade
4: Roller 4-1: Roller motor
5: Presser foot
6: Pressing point
7: Dust box
11: Leather 11-1: Skived Leather 11-2: Skived unnecessary Leather

What is claimed is:

1. A leather skiving machine comprising:
a table upon which a piece of leather is placed;
a roller for moving the leather;
a presser foot for pressing down the leather;
a flat blade for skiving the leather;
a flat blade oscillating motor for oscillating the flat blade;
a flat blade oscillating mechanism; and
a roller motor for rotating the roller;
wherein:
the leather is sandwiched from top and bottom by the roller and the presser foot at a pressing point on the table while being moved, the flat blade is provided at a position 0-5 mm in the movement direction from the pressing point and skives while oscillating the leather by the flat blade oscillating motor and the flat blade oscillating mechanism, the roller and the roller motor for driving the roller are a unit, the unit can move in a vertical direction by an action of a spring, and the leather skiving machine skives the leather while oscillating the flat blade with fixed horizontal and vertical directions parallel to a blade of the flat blade by a slider crank mechanism of the flat blade oscillating mechanism.

2. The leather skiving machine according to claim 1, wherein: the flat blade is a double-edged blade.

3. The leather skiving machine according to claim 2, wherein: a space for placing the leather is provided on the front side of the flat blade and on the table.

4. The leather skiving machine according to claim 1, wherein: a cutting edge of the flat blade and an upper end of the roller are exposed on an upper surface of the table, when an operator moves the leather toward the flat blade with both hands, the leather is placed on the roller and moved, sandwiched between the roller and the presser foot at the pressing point, and after the leather does not move in the vertical direction, the flat blade oscillates and skives the leather.

5. The leather skiving machine according to claim 4, wherein: a dust box is provided, after the leather is skived, a necessary leather moves on the table, and an unnecessary leather is stored in the dust box by the roller.

6. The leather skiving machine according to claim 5, wherein: the unit moves in the vertical direction by the spring, according to a thickness of the unnecessary leather, and the unnecessary leather can be discharged.

7. The leather skiving machine according to claim 1, wherein: a cutting edge of the flat blade and an upper end of the roller are exposed on an upper surface of the table, a dust box is provided, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, and an unnecessary leather is stored in the dust box by the roller.

8. The leather skiving machine according to claim 1, wherein: a cutting edge of the flat blade and an upper end of the roller are exposed on an upper surface of the table, a dust box is provided, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, the unit moves in the vertical direction by the spring, according to a thickness of the unnecessary leather, and the unnecessary leather can be discharged.

9. The leather skiving machine according to claim 1, wherein: an arm is attached to the presser foot, and a horizontal position of the pressing point can be adjusted by adjusting the position of the arm.

10. The leather skiving machine according to claim 1, wherein: two projecting parts for covering each of both ends of the oscillating flat blade is provided at a position in front of the pressing point on the table.

11. The leather skiving machine according to claim 10, wherein: a portion of the presser foot pressing the leather has a width between the two projecting parts.

12. The leather skiving machine according to claim 1, wherein: a cutting edge of the flat blade and an upper end of the roller are exposed on an upper surface of the table, a dust box is provided, an arm is attached to the presser foot, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, and a horizontal position of the pressing point can be adjusted by adjusting the position of the arm.

13. The leather skiving machine according to claim 1, wherein: a cutting edge of the flat blade and an upper end of the roller are exposed on an upper surface of the table, a dust box is provided, an arm is attached to the presser foot, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, the unit moves in the vertical direction by the spring, according to a thickness of the unnecessary leather, the unnecessary leather can be discharged, and a horizontal position of the pressing point can be adjusted by adjusting the position of the arm.

14. The leather skiving machine according to claim 1, wherein: a cutting edge of the flat blade and an upper end of the roller are exposed on an upper surface of the table, a dust box is provided, an arm is attached to the presser foot, two projecting parts for covering each of both ends of the oscillating flat blade is provided at a position in front of the pressing point on the table, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, and a horizontal position of the pressing point can be adjusted by adjusting the position of the arm.

15. The leather skiving machine according to claim 1, wherein: a cutting edge of the flat blade and an upper end of the roller are exposed on an upper surface of the table, a dust box is provided, an arm is attached to the presser foot, two projecting parts for covering each of both ends of the oscillating flat blade is provided at a position in front of the pressing point on the table, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, the unit moves in the vertical direction by the spring, according to a thickness of the unnecessary leather, the unnecessary leather can be discharged, and a horizontal position of the pressing point can be adjusted by adjusting the position of the arm.

16. The leather skiving machine according to claim 1, wherein: a cutting edge of the flat blade and an upper end of the roller are exposed on an upper surface of the table, a dust box is provided, an arm is attached to the presser foot, two projecting parts for covering each of both ends of the oscillating flat blade is provided at a position in front of the pressing point on the table, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, a horizontal position of the pressing point can be adjusted by adjusting the position of the arm, and a portion of the presser foot pressing the leather has a width between the two projecting parts.

17. The leather skiving machine according to claim 1, wherein: a cutting edge of the flat blade and an upper end of the roller are exposed on an upper surface of the table, a dust box is provided, an arm is attached to the presser foot, two projecting parts for covering each of both ends of the oscillating flat blade is provided at a position in front of the pressing point on the table, when an operator moves the leather toward the flat blade with both hands, the leather is placed on the roller and moved, sandwiched between the roller and the presser foot at the pressing point, and after the leather does not move in the vertical direction, the flat blade oscillates and skives the leather, after the leather is skived, a necessary leather moves on the table, an unnecessary leather is stored in the dust box by the roller, the unit moves in the vertical direction by the spring, according to a thickness of the unnecessary leather, the unnecessary leather can be discharged, a horizontal position of the pressing point can be adjusted by adjusting the position of the arm, and a portion of the presser foot pressing the leather has a width between the two projecting parts.

* * * * *